US010837725B2

(12) United States Patent
Kim

(10) Patent No.: US 10,837,725 B2
(45) Date of Patent: Nov. 17, 2020

(54) TOOLLESS FIRING PIN AND STRIKER REMOVAL SYSTEM

(71) Applicant: 4SEP18, LLC, Laguna Niguel, CA (US)

(72) Inventor: Kyung Tae Kim, Laguna Niguel, CA (US)

(73) Assignee: 4SEP18, LLC, Laguna Niguel, CA (US)

( * ) Notice: Subject to any disclaimer, the term of this patent is extended or adjusted under 35 U.S.C. 154(b) by 0 days.

(21) Appl. No.: 16/775,753

(22) Filed: Jan. 29, 2020

(65) Prior Publication Data

US 2020/0240732 A1 Jul. 30, 2020

Related U.S. Application Data

(60) Provisional application No. 62/798,444, filed on Jan. 29, 2019.

(51) Int. Cl.
*F41A 17/64* (2006.01)
*F41A 19/13* (2006.01)

(52) U.S. Cl.
CPC ..... *F41A 17/64* (2013.01); *F41A 19/13* (2013.01)

(58) Field of Classification Search
CPC ..... F41A 17/64; F41A 19/06; F41A 19/13
USPC ..... 42/69.01, 69.02, 70.08
See application file for complete search history.

(56) References Cited

U.S. PATENT DOCUMENTS 8,413,363 B1 * 4/2013 Karfiol ..... F41A 11/00 42/106
8,528,243 B1 * 9/2013 Glock ..... F41A 3/66 42/75.02
2002/0194762 A1 * 12/2002 Cominolli ..... F41A 17/72 42/70.06
2010/0263254 A1 * 10/2010 Glock ..... F41A 11/02 42/71.02
2011/0252686 A1 * 10/2011 Coleman ..... F41A 15/10 42/25
2012/0198744 A1 * 8/2012 Meller ..... F41C 3/00 42/90
2013/0000173 A1 * 1/2013 Green ..... F41A 17/64 42/70.11
2014/0298703 A1 * 10/2014 Gale ..... F41C 27/00 42/71.02
2015/0184966 A1 * 7/2015 Beck ..... F41A 17/56 42/70.08
2016/0040957 A1 * 2/2016 Finsand ..... F41C 33/008 224/269

(Continued)

OTHER PUBLICATIONS

Strike Industries Website Homepage, which is located at https://web.archive.org/web/20190101051617/https://www.strikeindustries.com/shop/ dated Jan. 1, 2019 (retrieved on Jan. 29, 2020).

*Primary Examiner* — Bret Hayes
(74) *Attorney, Agent, or Firm* — Fish IP Law, LLP

(57) ABSTRACT

A toolless slide backplate for a firearm that comprises an extractor lock and a striker assembly lock. The extractor lock is dimensioned to cover and contact an extractor plunger when installed, and is held in place via an interplay with the extractor plunger. The striker assembly lock is dimensioned to cover the striker components when installed. The striker assembly lock covers the trigger connector of the frame of the firearm such that a disassembly opening is not required.

6 Claims, 16 Drawing Sheets

(56) References Cited

U.S. PATENT DOCUMENTS

| | | | | |
|---|---|---|---|---|
| 2017/0211901 | A1* | 7/2017 | Keller | F41A 11/00 |
| 2018/0245868 | A1* | 8/2018 | Dechant | F41A 3/64 |

* cited by examiner

DETAIL A

Fig. 4
PRIOR ART
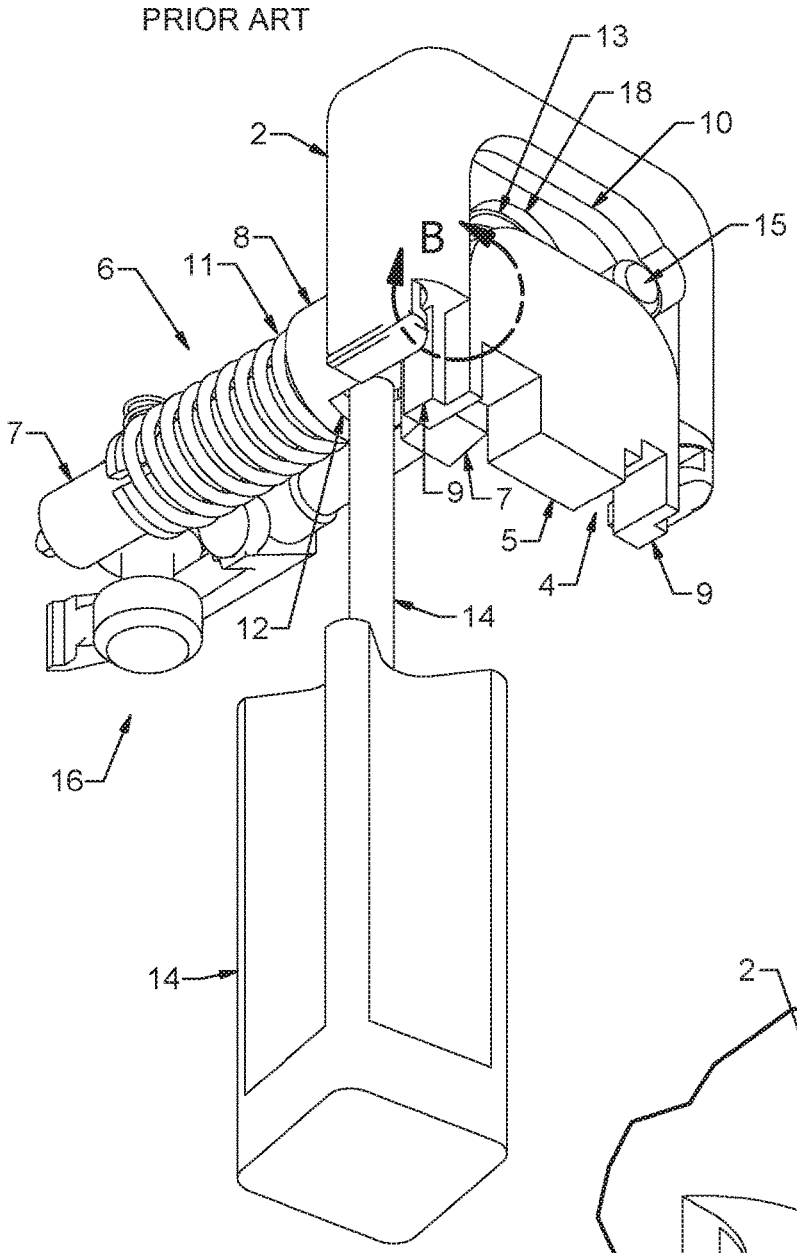
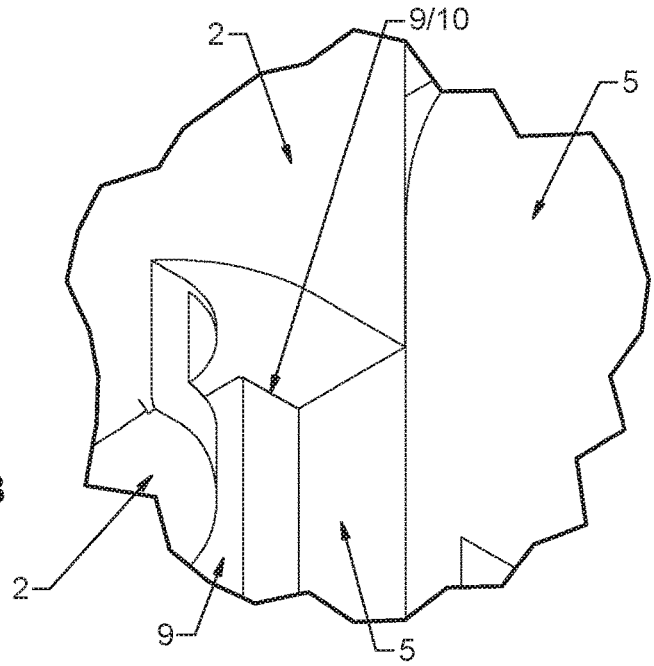
Fig. 5
PRIOR ART
DETAIL B

DETAIL C

DETAIL D

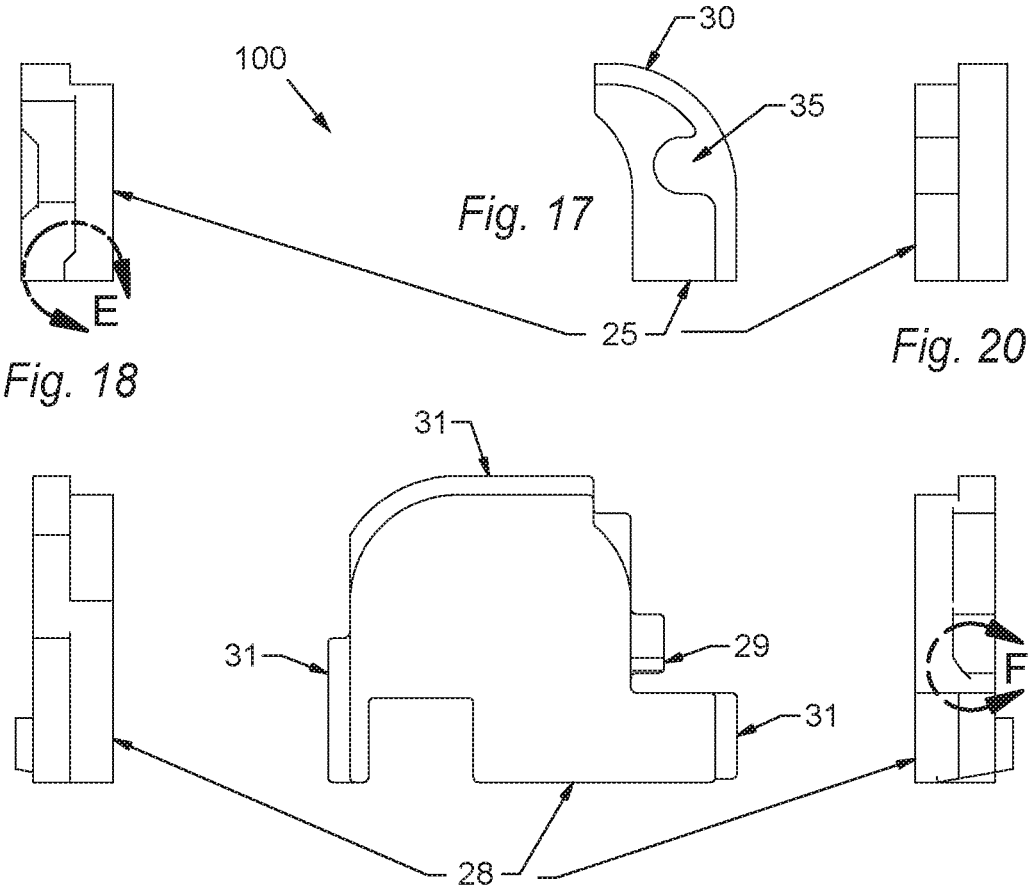
Fig. 17
Fig. 18
Fig. 20
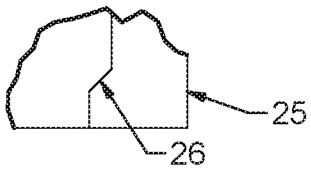
Fig. 19
DETAIL E
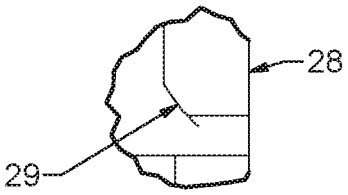
Fig. 21
DETAIL F

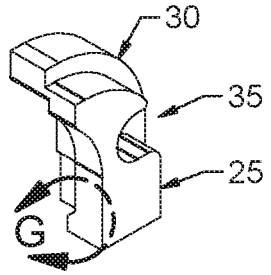
Fig. 22
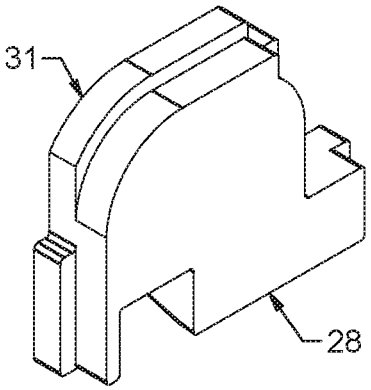
Fig. 23
DETAIL G
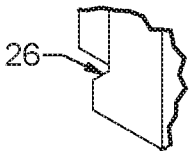
Fig. 24
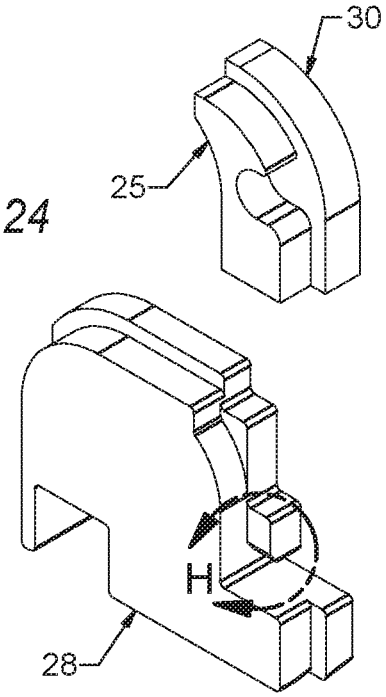
Fig. 25
DETAIL H
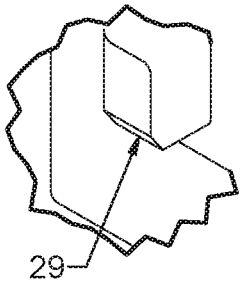

TOOLLESS FIRING PIN AND STRIKER REMOVAL SYSTEM

This application claims priority to U.S. provisional application 62/798,444, filed Jan. 29, 2019. U.S. provisional application 62/798,444 and all other extrinsic references contained herein are incorporated by reference in their entirety.

FIELD OF THE INVENTION

The field of the invention is firearm technologies.

BACKGROUND

The background description includes information that may be useful in understanding the present invention. It is not an admission that any of the information provided herein is prior art or relevant to the presently claimed invention, or that any publication specifically or implicitly referenced is prior art.

Field stripping is a common and necessary aspect of pistol's use and maintenance. This process often requires the removal of the pistol's slide and backplate.

Unfortunately, the process of removing a pistol's backplate is difficult and requires tools that are cumbersome to operation. Additionally, this process requires the positioning of the pistol's trigger such that the pistol could inadvertently fire.

Others have attempted to solve this problem. However, existing attempts at toolless pistol slide backplates still suffer from the deficiency of the default backplate in that a disassembly opening is required. This allows for dirt, grime or dust to enter the slide, creating a potential malfunction situation. Moreover, removal of these backplates can result in the undesired, accidental removal of extractor components from the slide.

Thus, there is still a need for simple, effective slide backplate that can be installed and removed without a tool and that overcomes the deficiencies of these prior attempts.

SUMMARY OF THE INVENTION

The inventive subject matter provides apparatus, systems and methods in which a toolless slide backplate comprises an extractor lock and a striker assembly lock which can be installed and removed without a tool. When installed onto a slide of a firearm, the extractor lock and striker assembly lock combine to cover the rear of the firearm.

The extractor lock is dimensioned to cover and come into contact with an extractor plunger installed within the slide of the firearm. The extractor lock includes lips that couple into corresponding grooves on the slide for installation.

In embodiments, the front surface of the extractor lock includes a divot with chamfered sides. In these embodiments, the divot is not aligned with the extractor plunger. Instead, the chamfered sides are aligned to contact corresponding rounded or chamfered edges of the extractor plunger. This causes the extractor plunger to exert a force on the extractor lock, holding it in place.

The striker assembly lock includes lips that mate with corresponding grooves of the slide for installation and removal. The striker assembly lock is dimensioned such that, when installed, it covers the striker assembly installed within the slide.

Each of the extractor lock and striker assembly lock include detent chamfers that are disposed such that they line up with one another during the installation of the striker assembly lock (when the extractor lock is already installed) and, when the striker assembly lock is released by the user at the end of the installation process, come into contact to hold each other in place.

The striker assembly lock is dimensioned such that it covers the space where a disassembly opening would be in the default backplate of the firearm. The ability to easily remove the striker assembly lock prior to the removal of the slide negates the need to have an opening to clear the trigger components of the frame as the slide is moved forward for removal.

Various objects, features, aspects and advantages of the inventive subject matter will become more apparent from the following detailed description of preferred embodiments, along with the accompanying drawing figures in which like numerals represent like components.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

BRIEF DESCRIPTION OF THE DRAWING

FIG. 4 is an isometric view of the components of FIG. 1 as the prior art slide backplate is disassembled from the pistol slide.

FIG. 5 is a detailed view of Detail B of FIG. 4.

FIG. 17 illustrates a rear view of the extractor lock and striker assembly lock, according to embodiments of the inventive subject matter.

FIG. 18 provides a view of the left side of the extractor lock and striker assembly lock of FIG. 17.

FIG. 19 is a detailed view of Detail E of FIG. 18.

FIG. 20 provides a view of the right side of the extractor lock and striker assembly lock of FIG. 17.

FIG. 21 is a detailed view of Detail F of FIG. 20.

FIG. 22 is a left-side isometric view of the extractor lock and striker assembly lock.

FIG. 23 is a detailed view of Detail G of FIG. 22.

FIG. 24 is a right-side isometric view of the extractor lock and striker assembly lock.

FIG. 25 is a detailed view of Detail H of FIG. 24.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIGS. 1-6 illustrate various views of a popular pistol design and its components. A well-known weakness of this design is that the user must actuate the trigger to initiate the field stripping/general cleaning process. Moreover, for a more thorough cleaning process requiring additional disassembly, the process requires use of a tool that is cumbersome.

Figure 1:
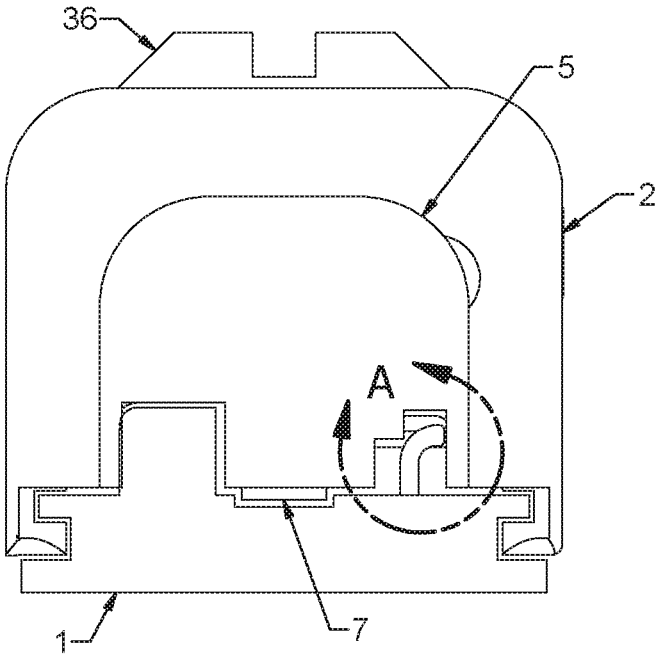
Fig. 1 PRIOR ART
FIG. 1 is a shooter's view of a backend of a pistol utilizing a prior art slide backplate.

FIG. 1 shows a user/shooter's view of the back/rear side of the pistol with a slide 2 having rear sight 36 assembled with pistol frame 1, with a prior art slide backplate 5 installed. Rear sight 36 is shown for reference and ease of understanding of the other components and is not illustrated in any other figures. The slide backplate 5 shown in FIG. 1 is a typical "default" slide backplate that is provided with a firearm from the manufacturer. Partial portion of pistol frame 1 is shown here for reference purposes only and will only be shown in subsequent figures as needed for further understanding.

Figure 2:
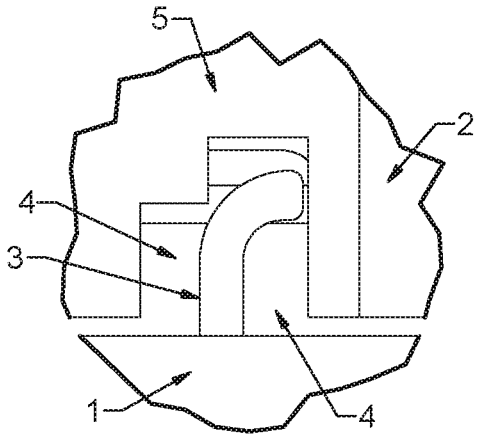
Fig. 2 PRIOR ART
FIG. 2 is a detailed view of Detail A of FIG. 1.

FIG. 2 shows a close-up view of Detail A of FIG. 1, showing the disassembly opening 4 of slide backplate 5, that is necessary for clearance of an integral part of the pistol frame called a trigger connector 3 during the prior art disassembly process. The trigger connector 3 is visible within the disassembly opening 4.

Figure 3:
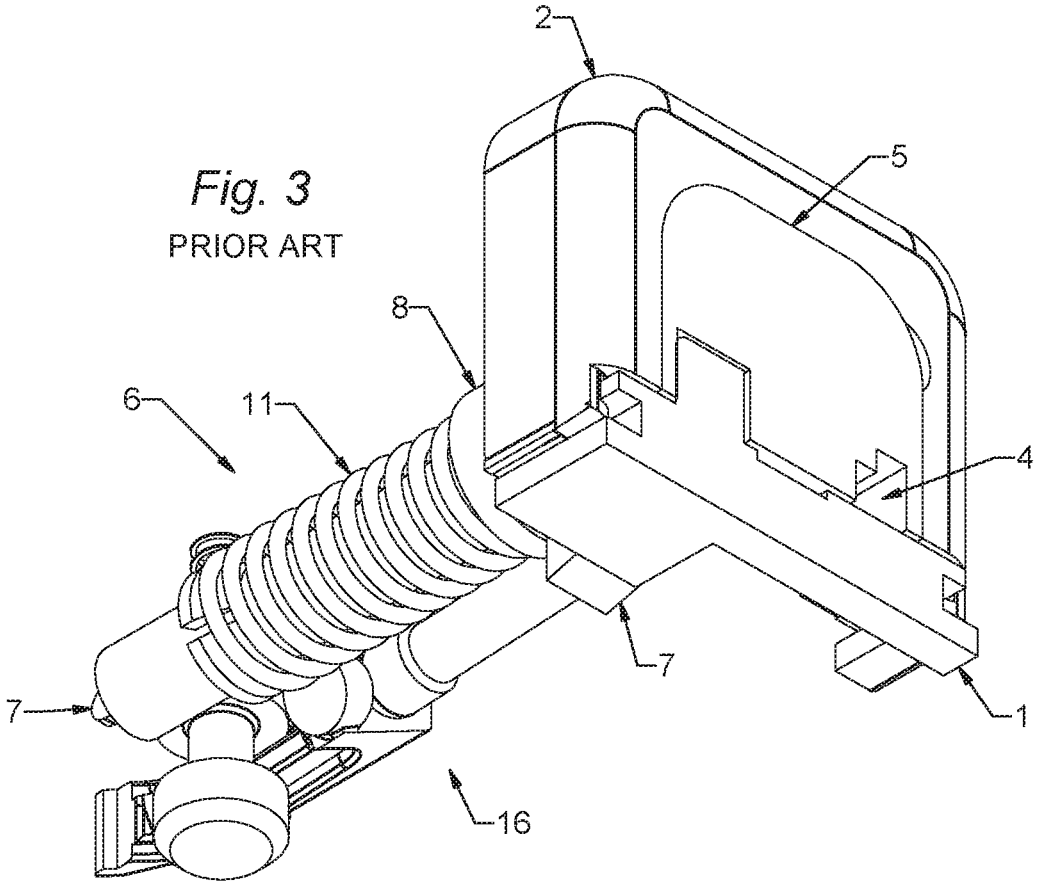
Fig. 3 PRIOR ART
FIG. 3 is an isometric view (with some components cut away for illustrative purposes) of FIG. 1.

FIG. 3 provides a perspective view of the assembly shown in FIGS. 1 and 2. In FIG. 3 and other subsequent figures, only a portion of slide 2 is shown in order to illustrate the relative positioning of the slide while also providing a view of the various components that are internal to the slide 2 when the slide is assembled. Visible in FIG. 3 is the striker assembly 6. Also partially visible in FIG. 3 behind the striker assembly 6 are the extractor components 16.

Figure 6:
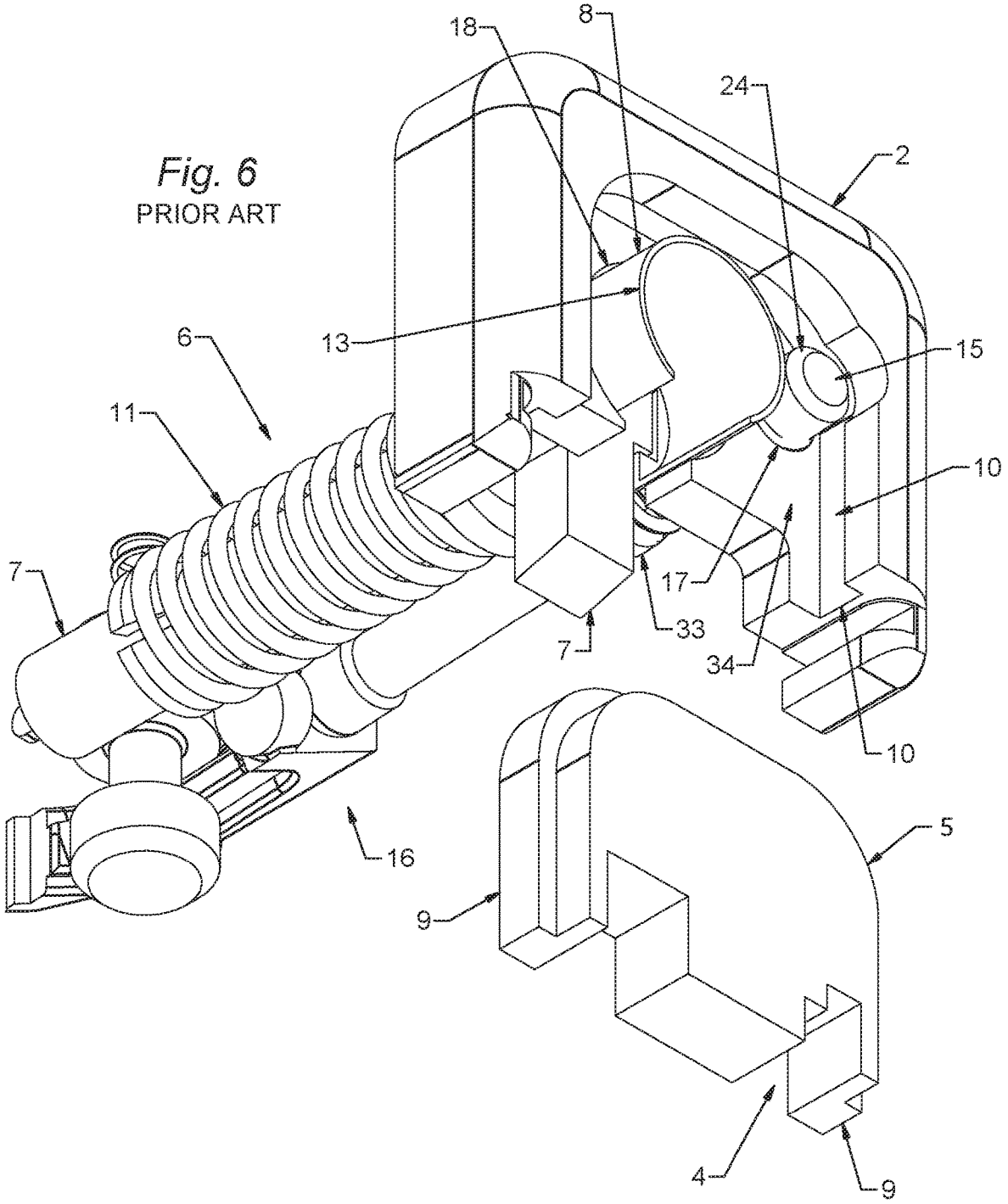
Fig. 6 PRIOR ART
FIG. 6 is an isometric view of the components of FIG. 1 and their positional relationships after the prior art slide backplate is removed.

FIGS. 4-6 illustrate how prior art slide backplate 5 fits into the slide 2 for installation or removal. Backplate 5 has a backplate lip 9 (FIGS. 4-6) that is slid up/down from the bottom side of slide 2 into a slide backplate groove 10 for installation/removal. The distal face of prior art slide backplate 5 further comprises a (known) locking depression (not shown) which interacts with striker assembly 6 to constrain prior art slide backplate 5 in the −Y direction, preventing downward movement of the backplate 5 (once prior art slide backplate 5 is installed). Prior art slide backplate 5 further comprises a disassembly opening 4 (FIGS. 1-4). Disassembly opening 4 allows prior art slide backplate 5 to clear trigger connector 3 (a known subcomponent of frame 1) during a well-known, typical disassembly process.

Figure 7:
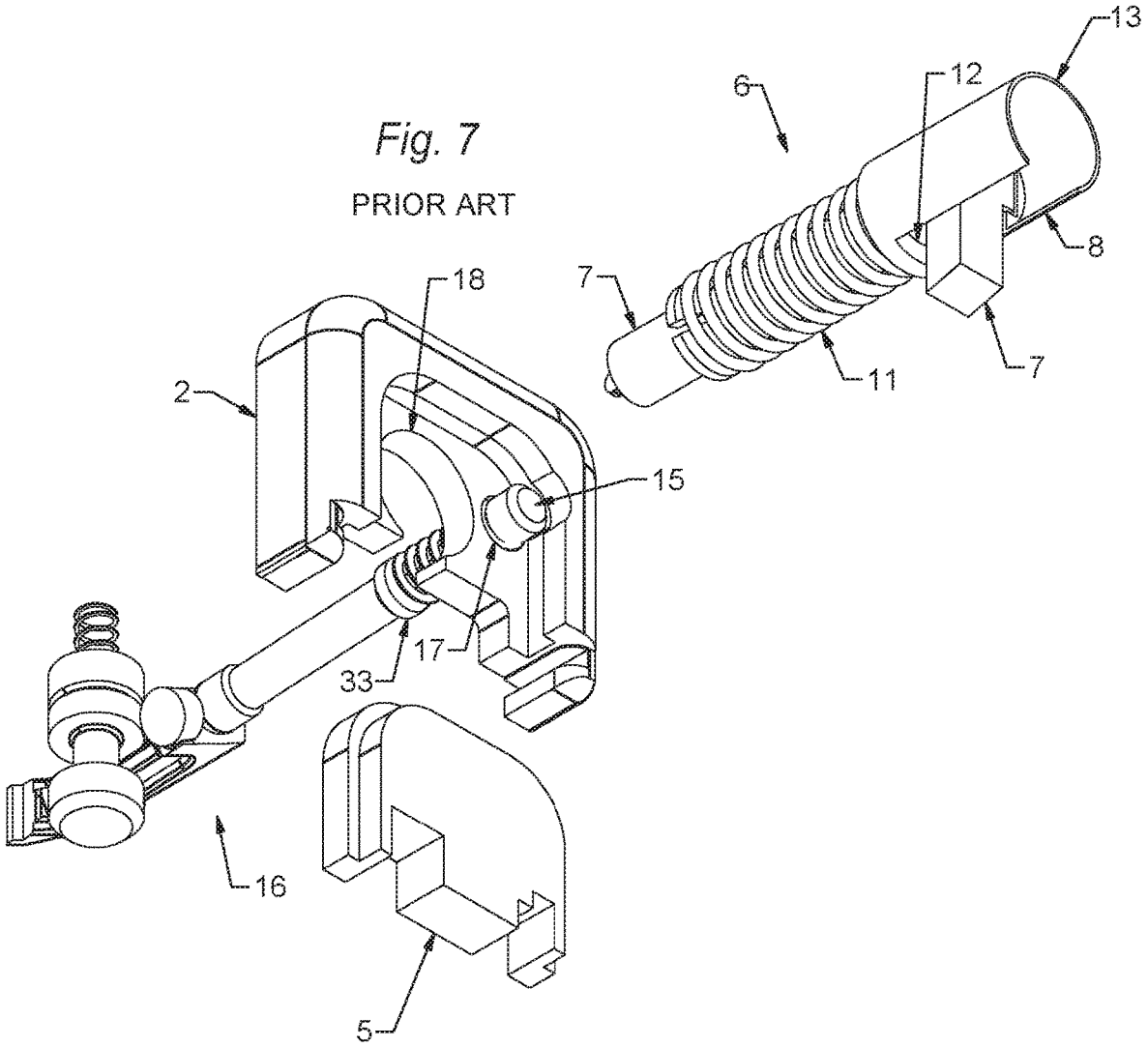
Fig. 7 PRIOR ART
FIG. 7 shows the components of FIG. 6, with the striker assembly removed.

The striker assembly 6 (shown removed from the slide 2 in FIG. 7) comprises a striker 7, a spring 11, and a sleeve 8. The sleeve 8 further comprises a disassembly bridge 12 and sleeve edge 13.

Sleeve 8 (and thus striker assembly 6) is constrained in the X, Y, Axes and +Z (forward, away from the shooter) directions by a striker assembly channel 18 (illustrated in FIGS. 4,7), which is a feature of slide 2. Prior art slide backplate lip 9 of prior art slide backplate 5 interacts with groove 10 of slide 2 (FIGS. 4-6) to constrain prior art slide backplate 5 in the X (lateral), Z (front-back) axes and +Y (upward) direction. When assembled, the sleeve edge 13 drops into the distal face locking depression of backplate 5 due to the biasing force exerted by spring 11, thus constraining prior art slide backplate 5 in the −Y (downward) direction (since sleeve 8 is itself constrained from movement along the Y Axis by striker assembly channel 18). Prior art slide backplate 5 in turn constrains striker assembly 6 as well as extractor components 16 in the =Z (rearward, toward the shooter) direction.

FIG. 4 shows the removal of prior art slide backplate 5. It is important to note that the removal of the prior art slide backplate 5 and subsequent removal of striker assembly 6 from slide 2 is not part of the prior art field stripping process. The removal of the striker assembly 6 bypasses the required (undesirable) trigger actuation of the prior art field stripping process. A tool 14 is utilized to push forward on disassembly bridge 12 (against the biasing force of spring 11). This in turn removes sleeve edge 13 from the locking depression of prior art slide backplate 5, allowing prior art slide backplate 5 to be slid down (in the −Y direction) and removed. FIG. 5 provides a close-up of Detail B of FIG. 4, showing the interplay between the lip 9 of backplate 5 and the groove 10 of slide 2.

FIG. 6 shows the components of the pistol and their positional relationships after prior art slide backplate 5 is removed. As seen in FIG. 6, striker assembly 6 and extractor plunger 15 (a subcomponent of extractor components 16) protrude rearwardly beyond a slide backplate cavity face 34 due to their respective springs' relaxed states.

At this point, striker assembly 6 is now no longer constrained within slide 2 and can be removed by pulling it in a rearward direction. Additionally, the relaxing of extractor spring 33 (seen in FIGS. 6, 7, 15, 16) disables (known but not described) extractor components-to-slide locking features. Thus, some of the extractor components 16 are free to be removed/fall rearwardly out of extractor channel 17. As this occurs the remaining extractor components are free to be removed/fall from the side and bottom of slide 2.

FIG. 4 also shows the first two steps in installing prior art backplate 5. First, sleeve 8 is pushed against the biasing force of spring 11 to sufficiently clear the front face/surface of prior art slide backplate 5 from sleeve edge 13. Prior art slide backplate 5 is then slid upward until its top edge abuts the extended (cylindrical) body of extractor plunger 15.

It should be noted that while sleeve edge 13 is large enough to be depressed by hand, extractor plunger 15 is not. The small size of extractor plunger 15 along with the strong outward biasing force of extractor spring 33 necessitates the use of a tool 14 for installation.

The final steps of prior art slide backplate 5 installation (not illustrated) requires the use of tool 14 to sufficiently depress extractor plunger 15 (into extractor channel 17) enough so that the extractor plunger 15 clears the front face/surface of prior art slide backplate 5. The prior art slide backplate 5 is then slid up completely.

Figure 8:
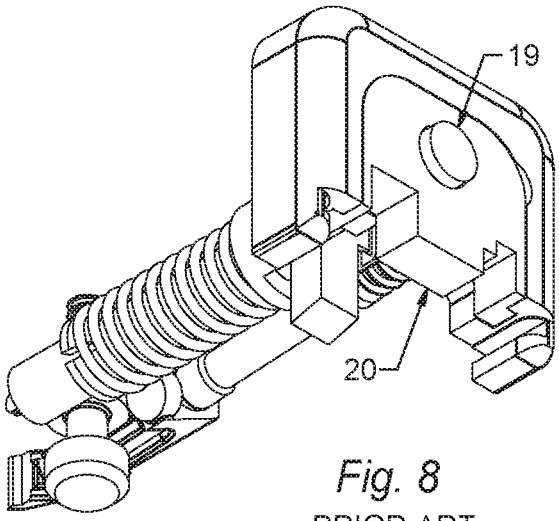
Fig. 8 PRIOR ART
FIG. 8 shows an installed toolless removable prior art slide backplate.

Others have attempted to develop backplates that allow for toolless disassembly of a slide. FIG. 8 shows a toolless prior art slide backplate 20 installed on a slide 2. The toolless backplate 20 includes a button 19 and a cylinder on the front face of backplate 20 (not shown). The cylinder aligns with the sleeve edge 13.

Figure 9:
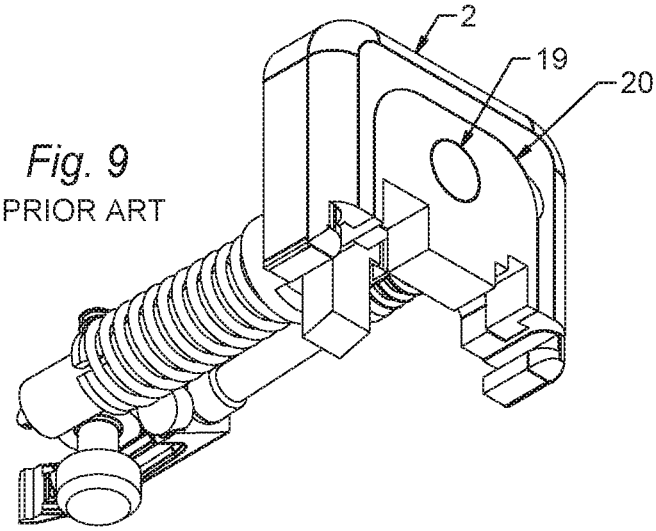
Fig. 9 PRIOR ART
FIGS. 9 and 10 illustrate the removal process of the toolless removable prior art slide backplate of FIG. 8.
Figure 10:
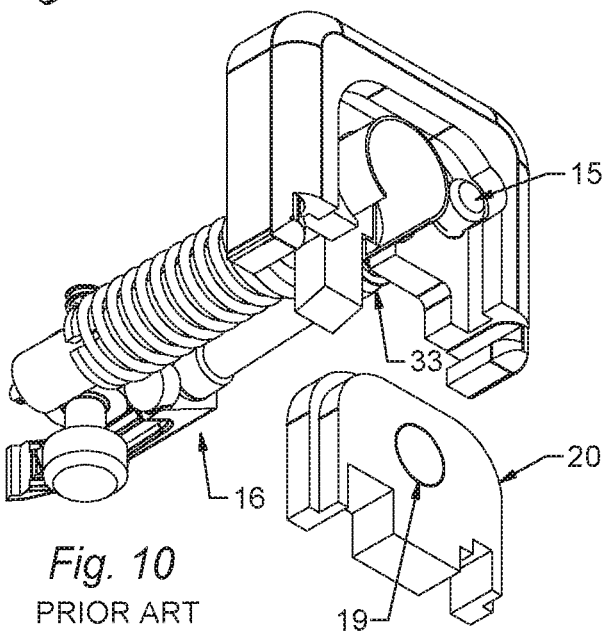
Fig. 10 PRIOR ART

FIGS. 9 and 10 illustrate the removal process of the toolless prior art slide backplate 20 from slide 2. To remove backplate 20, button 19 is pushed until it is approximately flush with the rear surface of the backplate 20. This causes the cylinder on the front face to push on the sleeve edge 13 against the force of spring 11, thus achieving the same effect as depressing sleeve 8 with tool 14 (as in FIG. 4). The toolless prior art backplate 20 can then be slid downward and removed from slide 2.

Despite these features, toolless prior art backplate 20 still suffers from deficiencies. Because the backplate 20 is entirely removed, this design allows the extractor components 16 to dislodge/fall out of the slide 2 during field stripping (as evidenced in FIG. 10, where upon removal of backplate 20 nothing prevents extractor components 16 from falling out if the pistol is tilted upward). Additionally, during installation, the prior art backplate 20 would still require a tool to depress extractor plunger 15 (as previously described for the installation of prior art slide backplate 5 in FIG. 4).

Figure 11:
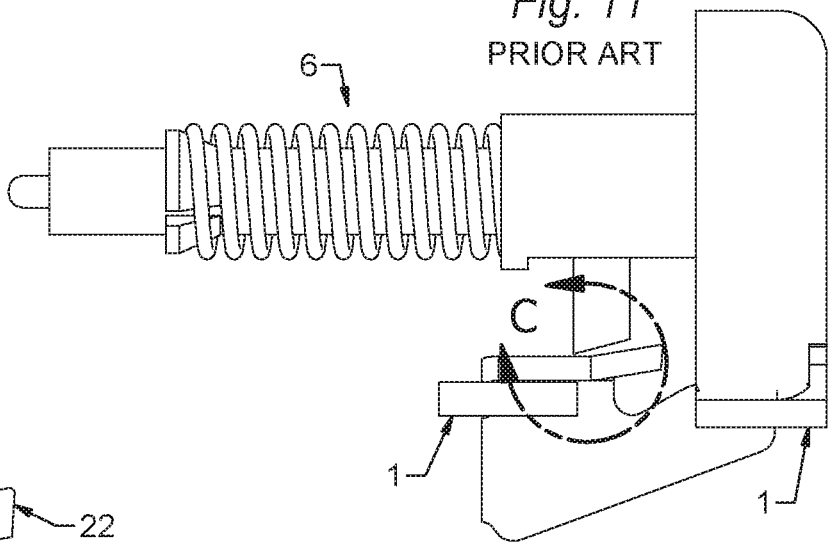
Fig. 11 PRIOR ART
FIG. 11 illustrates the initial stage of an improper pistol assembly (due to the design limitations of the prior art slide backplate and its pistol).
Figure 12:
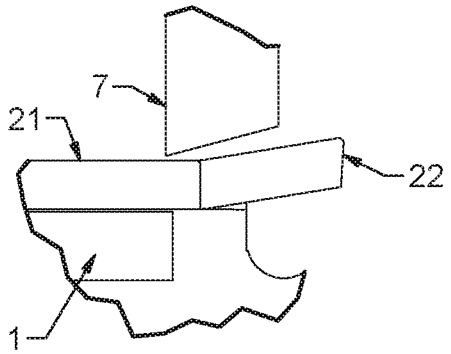
Fig. 12 PRIOR ART
FIG. 12 is a detailed view of Detail C of FIG. 11.

FIGS. 11 and 12 illustrate a pistol (utilizing a prior art slide backplate 5) being improperly assembled. As previously noted, striker assembly 6 remains within slide 2 during field stripping and assembly since prior art backplate 5 is not removed. Assembly of a pistol having prior art slide backplate 5 requires slide 2 with the striker assembly 6 installed within to be slid onto pistol frame 1 from the front to rear (left to right in these figures). When the pistol is improperly assembled with its trigger in a forward position (generally regarded as improper, but physically possible), a trigger bar 21 abuts the fixed pistol frame 1 so that the downward vertical movement (i.e., in the −Y direction) of trigger bar 21 is fixed. This places a feature of the trigger bar 21 above a horizontal operating plane of striker 7. Striker 7 must be moved backward (from left to right in these figures) above trigger bar 21 while being fixed in the Y Axis (i.e.—constrained so that no vertical movement of the striker 7 can occur) during assembly.

Figure 13:
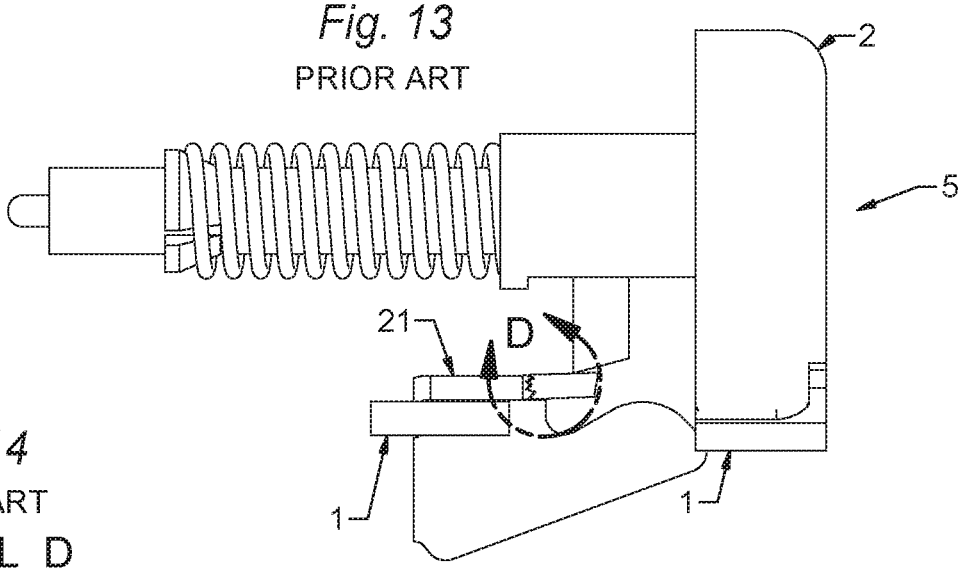
Fig. 13 PRIOR ART
FIG. 13 illustrates internal damage occurring as a result of improperly assembly with a prior art slide backplate.
Figure 14:
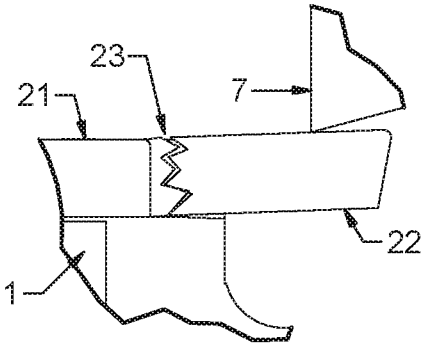
Fig. 14 PRIOR ART
FIG. 14 is a detailed view of Detail D of FIG. 13.

As shown in FIGS. 13 and 14, this condition leads to a situation where the bottom portion of striker 7 could bend down and/or crack 23 the sear (bent up portion) 22 of trigger bar 21 and/or deform pistol frame 1 (where trigger bar 21 abuts pistol frame 1) during assembly.

A broken sear 22 would lead to an inoperable weapon, whereas a cracked/bent down sear 22 would lead to an even more dangerous situation where striker 7 could inadvertently release (and thus fire the pistol) with the slightest jarring/bumping.

Figure 15:
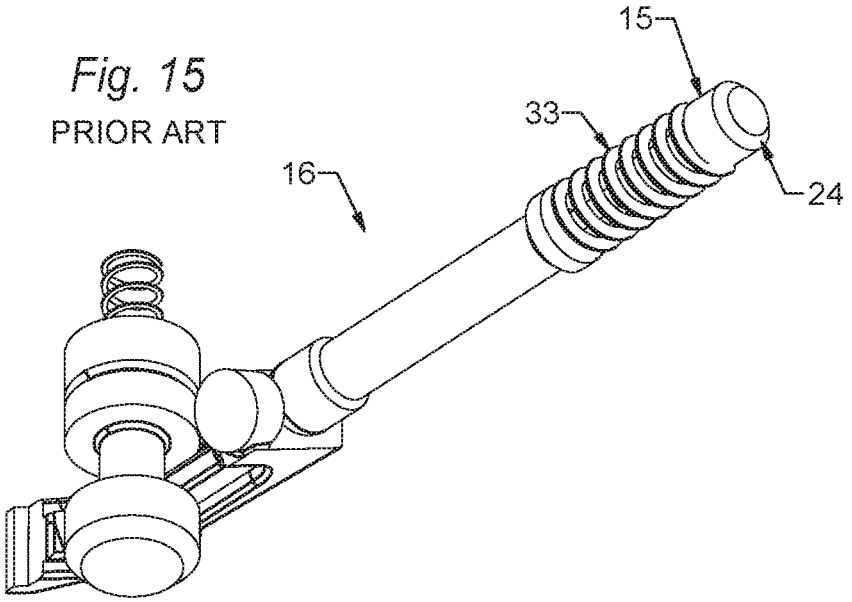
Fig. 15 PRIOR ART
FIG. 15 illustrates the extractor components and their positional relationships when they are captured within the slide (slide not shown).
Figure 16:
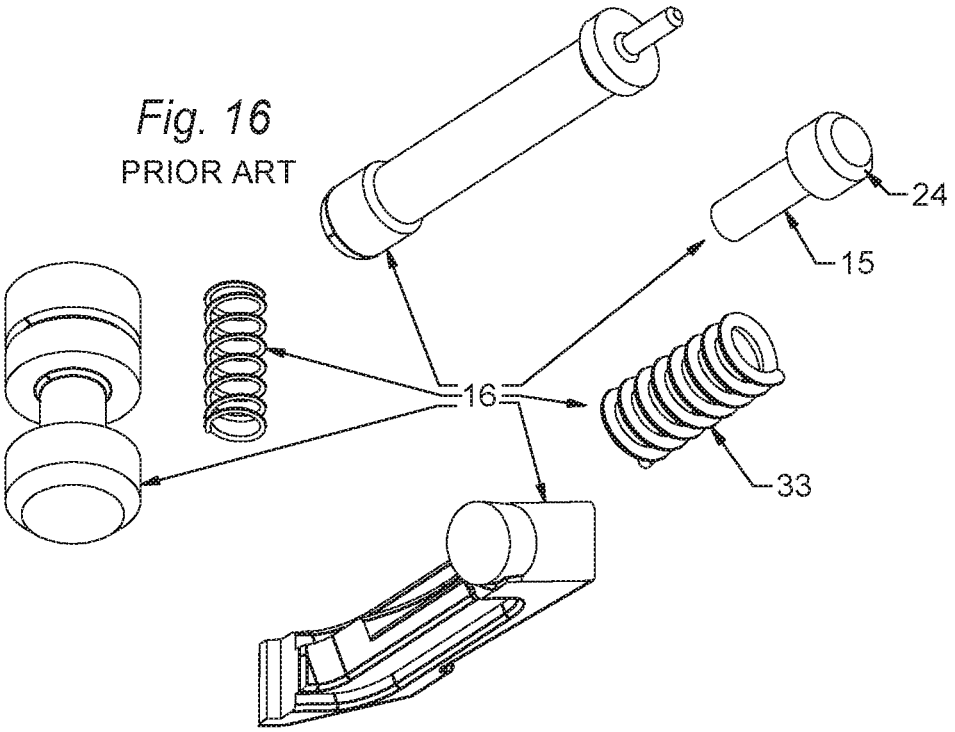
Fig. 16 PRIOR ART
FIG. 16 illustrates the individual extractor components when they are freed from the slide.

FIG. 15 illustrates extractor components 16 and their positional relationships when they are captured within slide 2 (slide 2 not shown). FIG. 16 illustrates the individual components of extractor components 16 in an exploded view, when they are not contained (e.g., if they fall out of the pistol by the removal of prior art slide backplate 5 or toolless prior art backplate 20).

FIG. 17 shows a rear view of a toolless slide backplate 100 according to an embodiment of the inventive subject matter. As seen in FIG. 17, the toolless slide backplate 100 includes a striker assembly lock 28 and an extractor lock 25 which combine to replace the prior art slide backplate 5. FIGS. 18 and 20 provide side views of the assembly lock 28 and extractor lock 25, while FIGS. 22 and 24 show perspective views of the striker assembly lock 28 and extractor lock 25.

The extractor lock 25 includes a lip 30 that is dimensioned to fit in a corresponding section of the groove 10 of the slide 2 when installed. As seen in FIG. 19, which is a close-up view of detail E of FIG. 18, the extractor lock 25 also includes an extractor lock detent chamfer 26. This is also illustrated in FIG. 23, which is a close-up view of detail G of FIG. 22. In the embodiments discussed herein, the extractor lock detent chamfer 26 is forward-facing. In embodiments such as the one discussed herein, the extractor lock 25 illustrated herein also includes a disassembly notch 35, the function of which will be explained in further detail below. In other embodiments, the extractor lock 25 does not include the disassembly notch 35.

The striker assembly lock 28 includes lips 31 that are dimensioned to fit within the groove 10 of the slide. As seen in FIG. 21, which is a close-up view of detail F of FIG. 20, assembly lock 28 also includes a striker lock detent chamfer 29 that is positioned and dimensioned to come into contact with extractor lock detent chamfer 26 of the extractor lock 25 when the striker assembly lock 28 and the extractor lock 25 are assembled and installed within slide 2. The striker lock detent chamfer 29 is also visible in FIG. 25, which is a close-up view of detail H of FIG. 24. In the embodiments shown herein, the striker lock detent chamfer 29 is rear-facing.

When installed, the lips 31 of striker assembly lock 28 and lips 30 of extractor lock 25 seen in FIGS. 17-25 serve the same function as the lips 9 of prior art slide backplate 5 seen in FIGS. 4-6).

Figure 26:
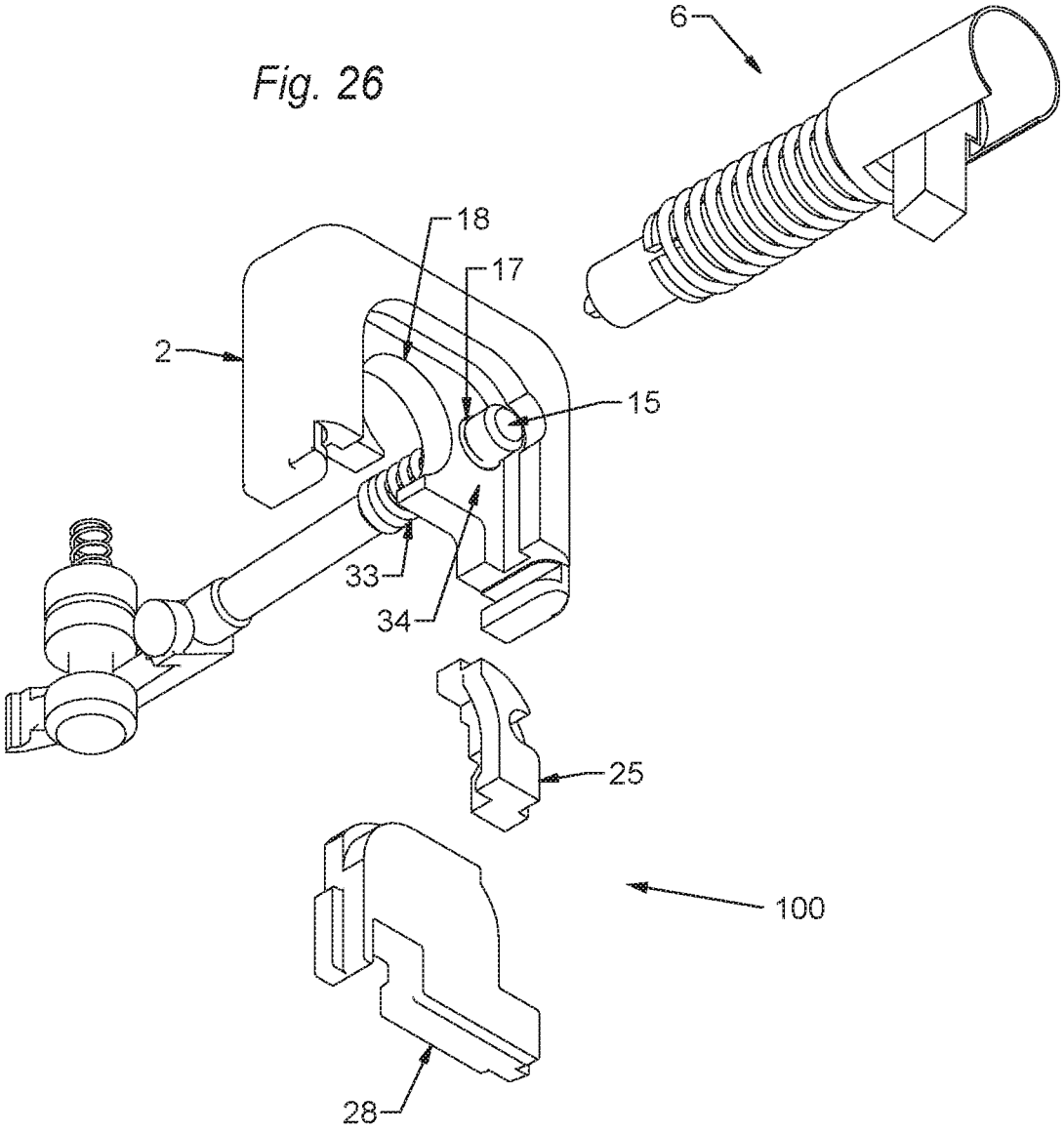
FIG. 26 is an isometric view of the striker assembly lock and extractor lock prior to installation.

FIG. 26 shows a striker assembly 6 removed from the slide 2, with the extractor lock 25 and striker assembly lock 28 of backplate 100 of the inventive subject matter prior to assembly and installation.

Figure 29:
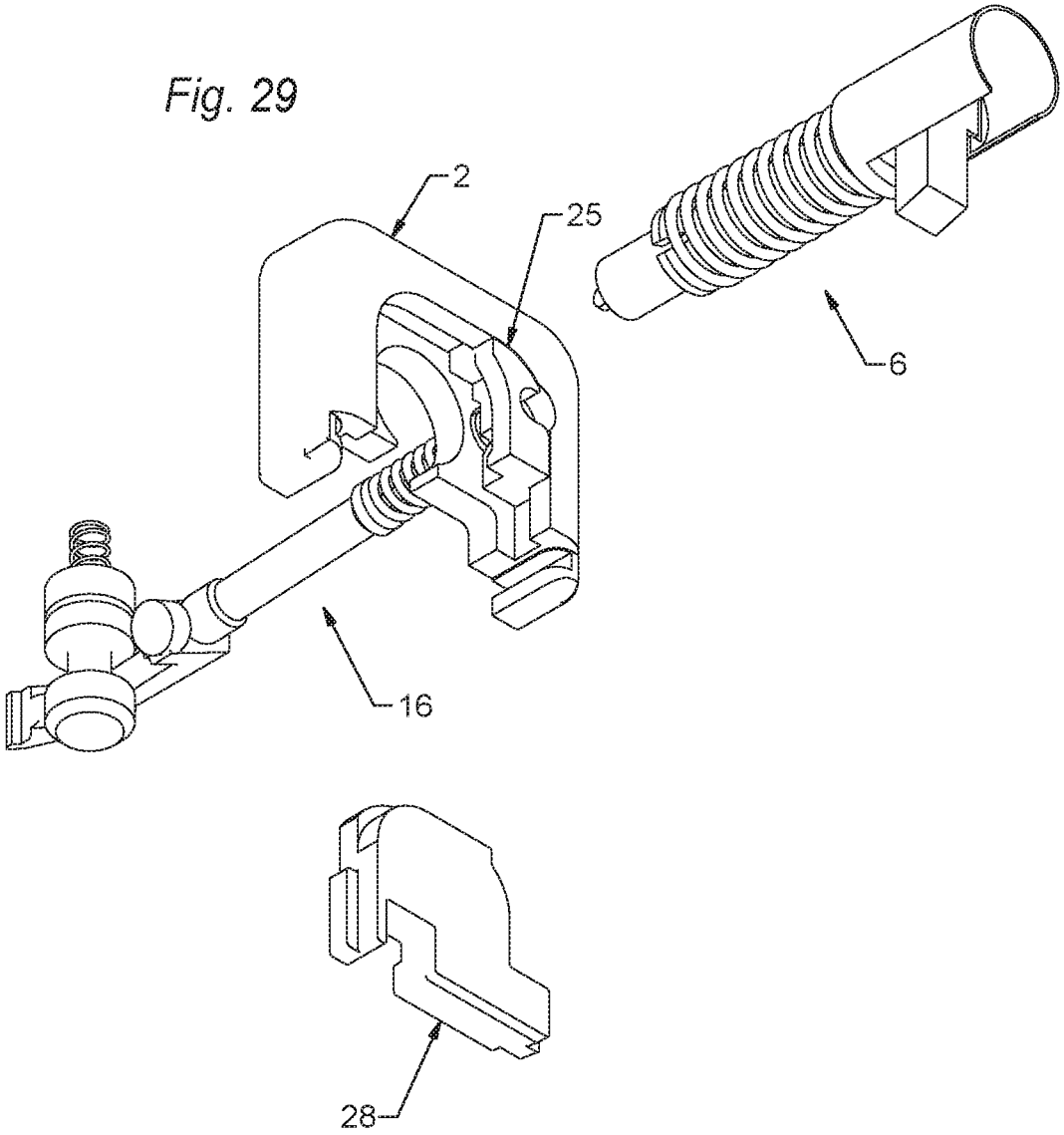
FIG. 29 shows the extractor lock installed.

To install the backplate 100 into a slide 2, the extractor lock 25 is first installed. As seen in FIGS. 26 and 29, the striker assembly 6 is not installed and does not have to be installed within the slide 2 for the extractor lock 25 to be installed.

When a backplate is removed from slide 2, the bias of extractor spring 33 causes the extractor plunger 15 to extend rearwardly out of cavity 17 and beyond the plane of slide backplate cavity face 34 as seen in FIG. 26. Thus, to install the extractor lock 25, a tool (not shown) is utilized in a one time installation process to push the extractor plunger 15 into extractor channel 17 against the force exerted by extractor spring 33. While doing so, the lip 30 of extractor lock 25 is guided into place within the corresponding groove 10 of the slide. When the user releases the extractor lock 25, the biasing force of extractor spring 33 pushes the extractor plunger 15 into extractor lock 25, causing the extractor lock 25 to be held in place.

Figure 27:
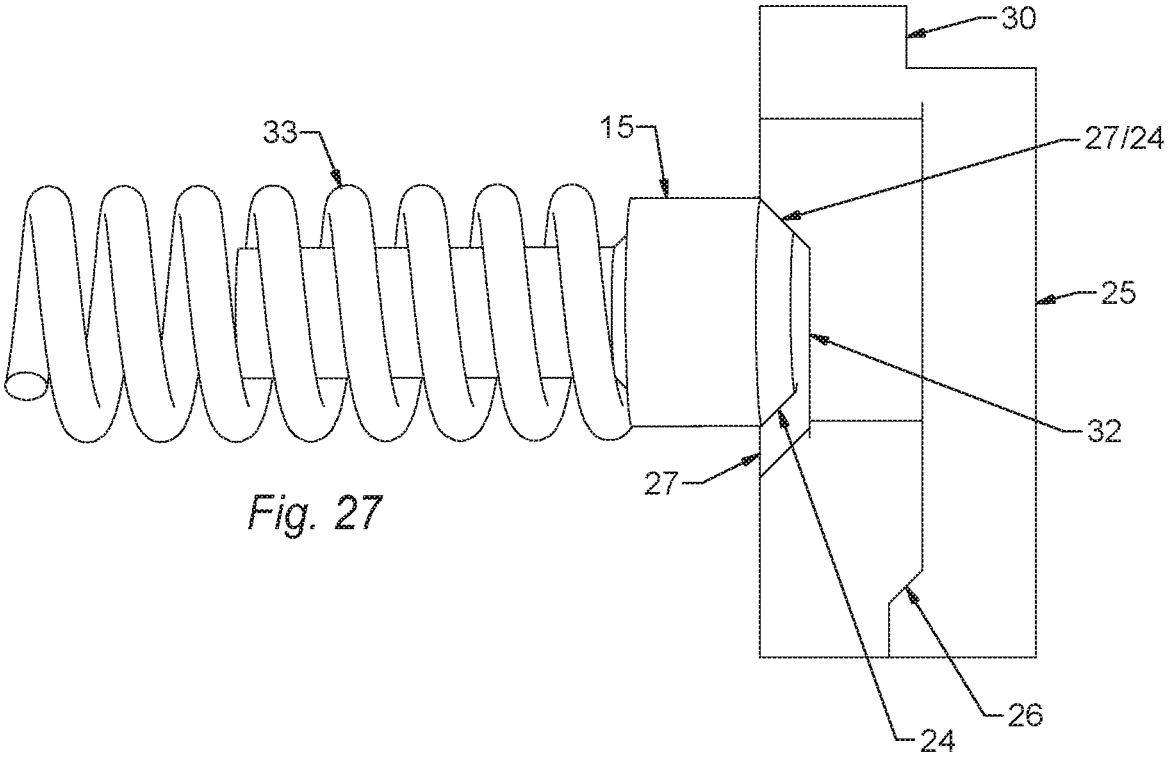
FIGS. 27 and 28 show side and bottom-front isometric views (respectively) of the interplay between the divot of the extractor lock and the extractor components.
Figure 28:
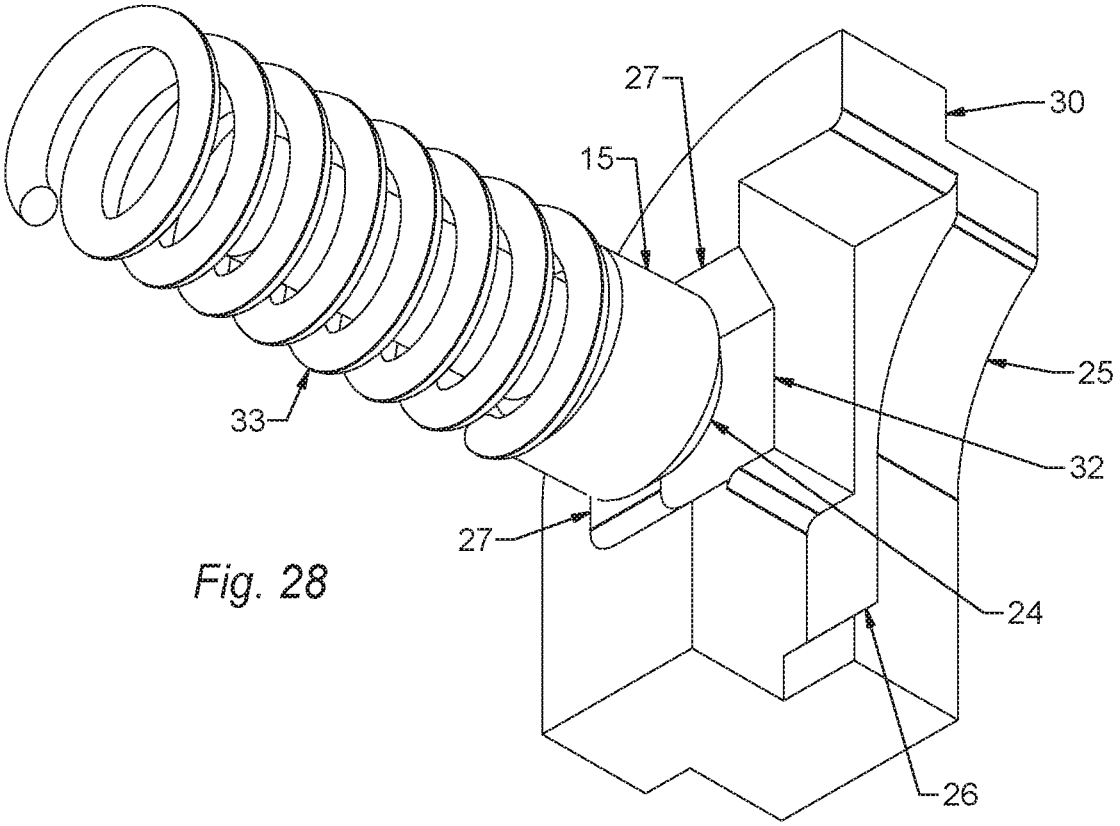

FIGS. 27 and 28 show left side and bottom-front isometric views (respectively) of the interplay between extractor plunger 15 and extractor lock 25. As seen in FIGS. 27 and 28, the front side of extractor lock 25 includes a divot 32 with chamfered sides 27 that angle inward from the edges of the divot 32. The divot 32 is disposed on the front side of the extractor lock 25 such that it does not align with the axis of the extractor channel 17 when the extractor lock 25 is installed. Instead, the divot 32 is disposed on the front of extractor lock 25 such that when installed, one or more of the chamfered sides 27 of the divot 32 contact a corresponding chamfered surface 24 of the extractor plunger 15 (in this case, the top and "right" chamfered surfaces 27 of divot 32, as viewed from the rear). As further seen in FIG. 27, the depth of the divot 32 is such that the extractor plunger 15 does not "bottom out" within divot 32. The "misalignment" of the divot 32 relative to the extractor channel 17 forces the extractor plunger 15 and divot 32 to interact only via the contact of their respective chamfers 24 and 27. This chamfer-to-chamfer contact generates a skewing force which biases extractor lock 25 firmly into the upper righthand corner of the slide backplate cavity when extractor lock 25 is installed, as seen in FIG. 29. It should be noted that, in embodiments of the inventive subject matter, the chamfered surface 24 of the extractor plunger 15 can instead be a rounded surface.

Once installed, the placement of extractor lock 25 is intended to be semi-permanent, meaning it can be removed but is intended to stay in place without removal unless necessary. To assist in removal, a tool can be utilized via disassembly notch 35 (though not strictly required) to remove extractor lock 25 on the very infrequent occasions when complete thorough cleaning of extractor components 16 is required.

Figure 30:
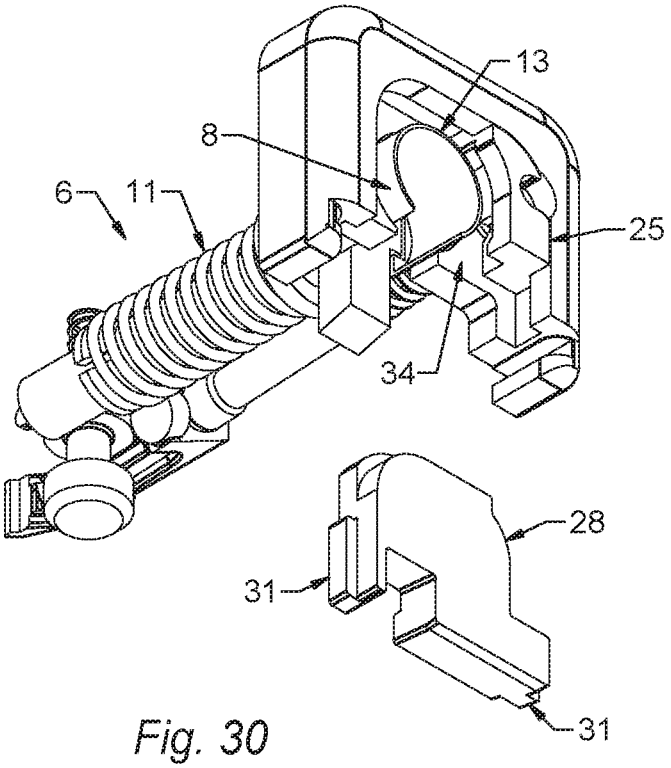
FIG. 30 illustrates the inserted (but not yet secured) striker assembly within a slide, with the striker assembly lock yet to be installed.

FIG. 30 illustrates the inserted (but not yet secured) striker assembly 6 in the slide 2, with the extractor lock 25 installed and the striker assembly lock 28 not yet installed. In this state, sleeve edge 13 of sleeve 8 protrudes rearwardly beyond slide backplate cavity face 34.

Figure 31:
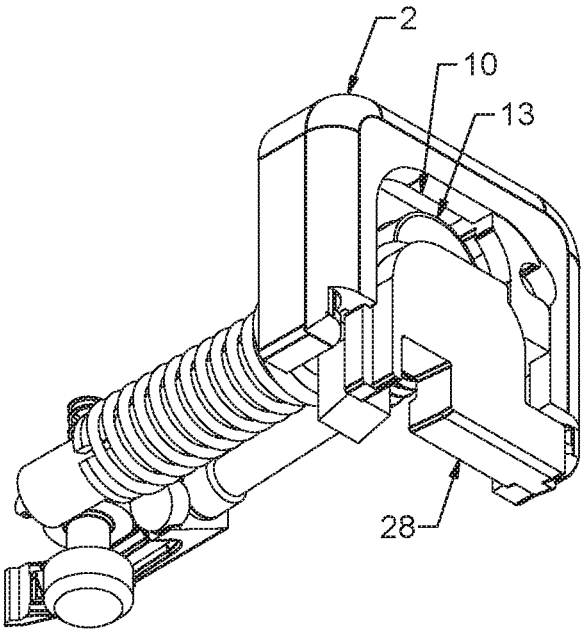
FIGS. 31-34 illustrate the four-step installation process for installing the striker assembly lock to secure the striker assembly.

FIG. 31 illustrates the first (of four) steps to install the striker assembly lock 28 and thus secure striker assembly 6 within the slide 2. The distal face of striker assembly lock 28 is brought up to contact and cover the bottom half semicircular portion of sleeve edge 13. In this state, the plane of the proximal face of striker assembly lock 28 is "above" (i.e., more rearward of and closer to the user than) the plane of the rear face of slide 2 as well as the installed extractor lock 25.

Figure 32:
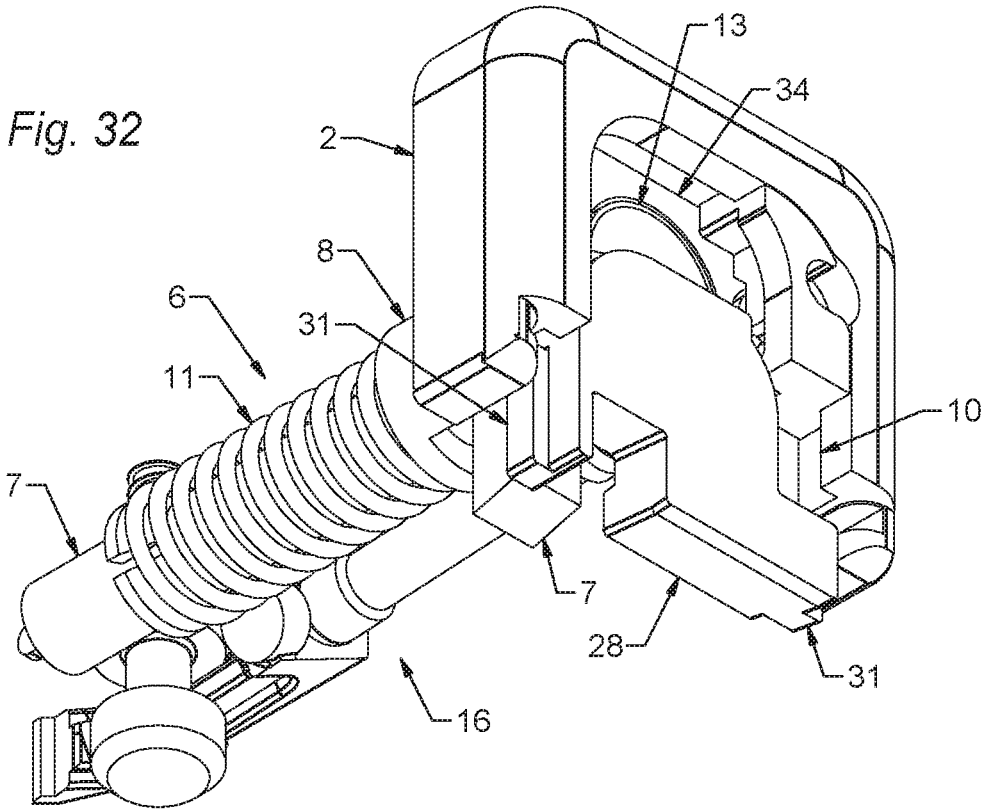

The second step of installing the striker assembly lock 28 is shown in FIG. 32. As seen in FIG. 32, the striker assembly lock 28 is pushed forward (i.e.—away from the user and into the slide 2) until its front side abuts slide backplate cavity face 34. In this state, the front face of striker assembly lock 28, the rear edge of sleeve edge 13, and the slide backplate cavity face 34 are all coplanar and the plane of the proximal face (rear side) of striker assembly lock 28 is forward (i.e.—deeper in) of the plane of the rear face of slide 2 and of extractor lock 25. This forward position of striker assembly lock 28 during this step creates sufficient separation (along a long axis of the slide 2) of the extractor lock detent chamfer 26 of extractor lock 25 and the striker lock detent chamfer 29 of striker assembly lock 28 to allow assembly of striker assembly lock 28 with the extractor lock 25. In other words, this separation allows the detents 26 and 29 to be brought into alignment without yet contacting each other (and thus interfering with the assembly).

Figure 33:
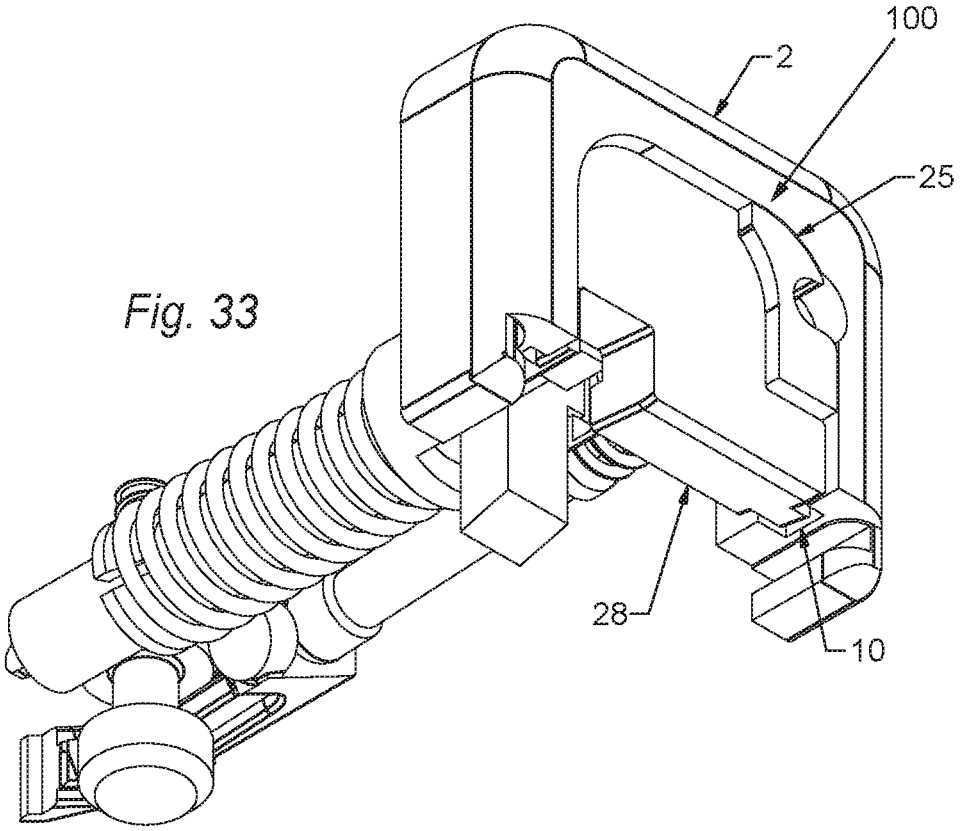

FIG. 33 shows the third step of the assembly process, whereby striker assembly lock 28 is slid completely up into the slide backplate cavity with the lips 31 sliding up into the slide grooves 10 of slide 2. FIG. 33 also shows the position of the rear surface of the striker assembly lock 28 relative to the rear positions the slide 2 and installed extractor lock 25 mentioned in the discussion of FIG. 32.

Figure 34:
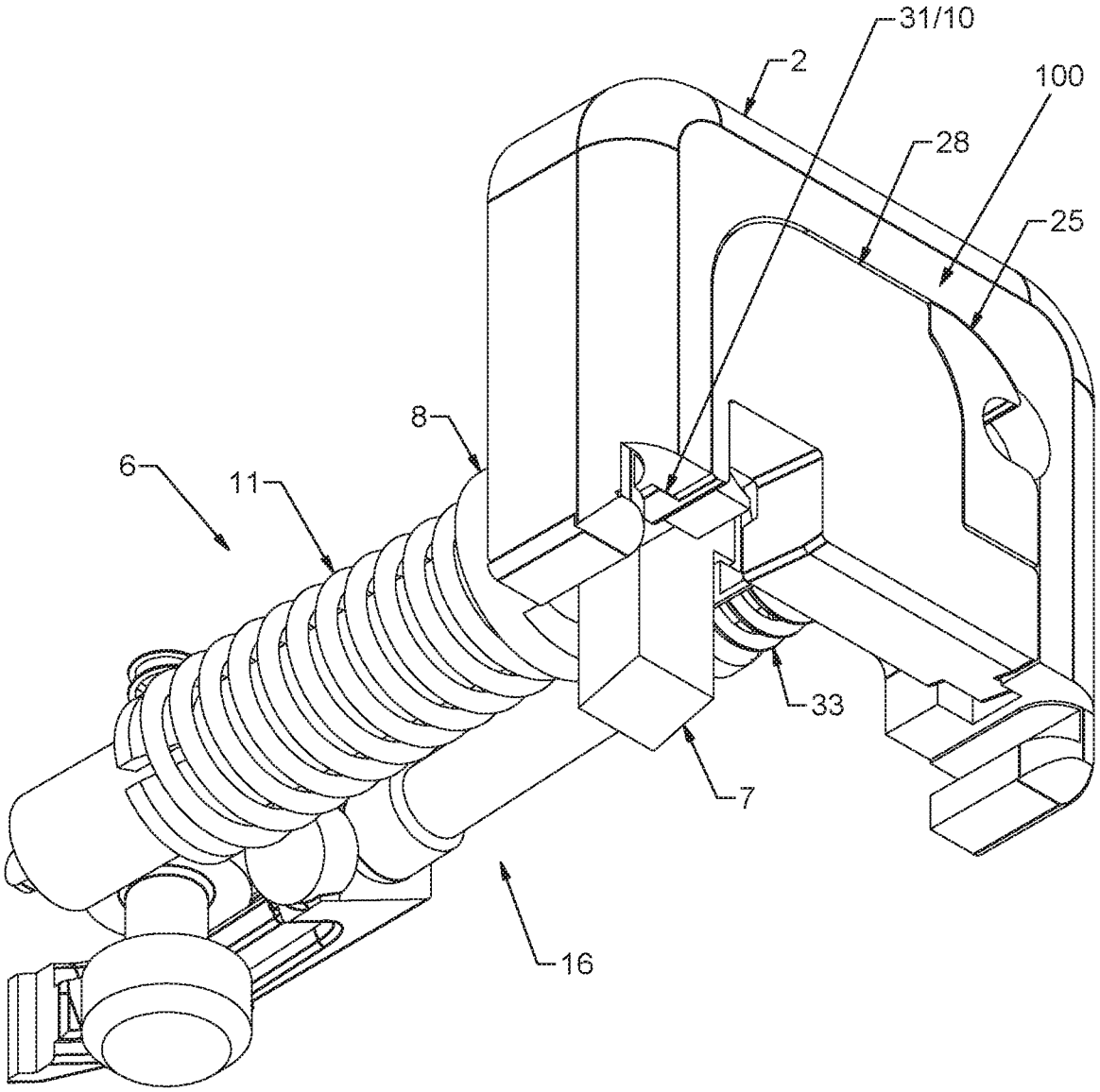

The fourth (and final) step of installation is shown in FIG. 34, where the striker assembly lock 28 has been installed and released by the user. When the striker assembly lock 28 is completely in place following the sliding upward of FIG. 33, it is released by the user. Upon release by the user, the spring 11 of striker assembly 6 biases sleeve 8 rearwardly against the striker assembly lock 28. This rearward bias causes the rear faces of lips 31 of striker assembly lock 28 to push against the corresponding front faces of the slide grove 10, as well as bringing the striker lock detent chamfer 29 of the striker assembly lock 28 into contact with the extractor lock detent chamfer 26 of the extractor lock 25 and causing them to push against each other. This brings the "over-the-detent" locking actions of the corresponding detent chamfers 26 and 29 together. At this stage, the striker assembly lock 28 is "locked up" into the slide backplate cavity. When the backplate 100 is fully installed, the rear surfaces of striker assembly lock 28 and the extractor lock 25 are all coplanar. In the embodiments shown, these rear surfaces of striker assembly lock 28 and extractor lock 25 are also coplanar with the rear surface of the slide 2.

Field stripping of the assembled slide 2 equipped with slide backplate 100 is accomplished in reverse order of the steps of FIGS. 31-34. The striker assembly lock 28 is first pushed in against the biasing force of spring 11 to disengage the detents 26, 29 and then slid down to remove the lips 31 from groove 10, thus removing the striker assembly lock 28 from the slide 2. The striker assembly 6 can now be removed from the slide 2 (which inerts the pistol). As discussed above, the extractor lock 25 secures the extractor components 16 within slide 2. Once striker assembly 6 is removed, the pistol can be further field stripped as is commonly known without having to actuate/pull the trigger.

As seen in FIGS. 17-34, the sides of striker assembly lock 28 and extractor lock 25 are dimensioned such that, when they are installed within slide 2, they cover the rear of the slide 2. As seen in FIG. 34, the striker assembly lock 28 completely covers the trigger connector 3 (FIGS. 1 and 2) of the pistol frame 1. Unlike the prior art backplates of FIGS. 1-14, the striker assembly lock 28 does not have (nor require) a disassembly opening such as the disassembly opening 4 of prior art backplate 5 (shown in FIGS. 1-4).

As discussed above, the prior art backplates include the disassembly opening 4 because, when field stripping the firearm, the slide 2 is slid forward off the pistol frame 1. During this movement forward, the backplate 5 must be able to clear the trigger connector 3 of frame 1 in order for slide 2 to be removed. Accordingly, the disassembly opening 4 is necessary in the prior art slide backplates 5 and 20 so that the trigger connector 3 can be cleared.

In contrast, during field stripping a pistol equipping the backplate 100 of the inventive subject matter, the striker assembly lock 28 can be removed from the pistol before the slide 2 is moved forward for removal from pistol frame 1. Because the slide 2 can be moved forward without the striker assembly lock 28 attached, the trigger connector 3 is cleared and no obstacle to removing the slide 2 exists. As such, the disassembly openings 4 of prior art slide backplates 5 and 20 are unnecessary. Without any unnecessary gaps such as disassembly opening 4, the backplate 100 of the inventive subject matter decreases the likelihood of foreign object (e.g., dust, dirt, grime, etc.) intrusion into the pistol that could cause a malfunction. Thus, reliability of the assembled pistol is increased.

Additionally, being able to easily remove the firing pin/striker to inert the firearm allows for its safe storage without having to utilize cumbersome and detrimental cable type locking devices which force partial compression of the firearm's recoil spring. Over time, this partial compression causes degradation of the recoil spring's biasing force, which reduces the reliability of the firearm.

Figure 35:
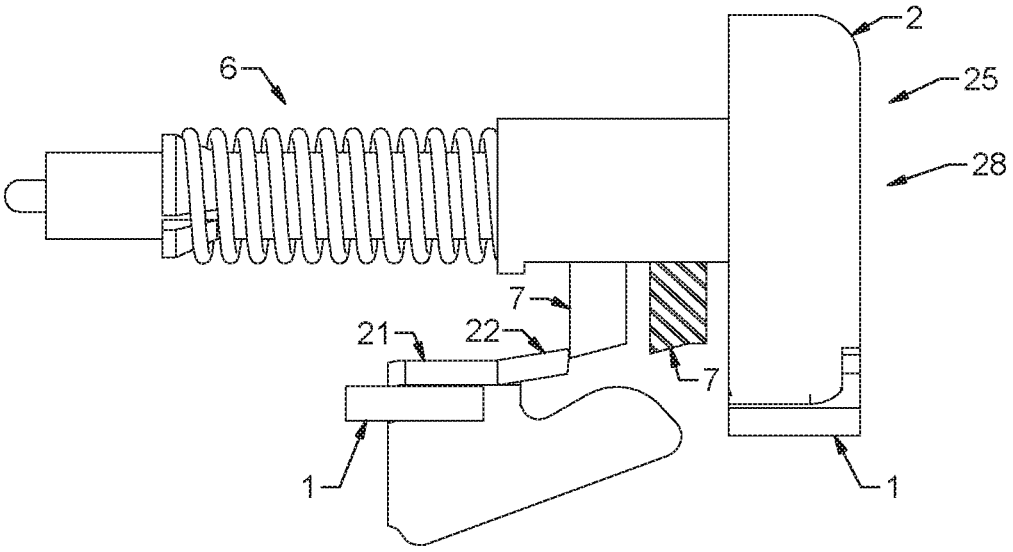
FIG. 35 illustrates the installation of the striker components in a firearm equipped with the toolless slide backplate of the inventive subject matter.

Another advantage of the backplate 100 of the inventive subject matter is that the striker assembly 6 can be installed after the slide 2 is attached to frame 1. This order of operations ensures that striker 7 will always be installed to contact sear 22 from the backside (i.e.—closer to the user) of sear 22 when the pistol is assembled with its trigger in the forward position. This is illustrated in FIG. 35, showing the position of the striker 7 during installation (the hatched depiction of the striker 7) and then at the final position (shown by the solid depiction of striker 7). The ability to install striker 7 from the rear of the pistol eliminates the possibility of the damage described in FIGS. 11-14 and the subsequent undesirable consequences.

Although the invention is illustrated in reference to a particular brand of firearm (a Glock), the invention is not intended to be limited to that particular brand.

The invention could be manufactured using any industry standard materials (e.g., metals, alloys, sheet metal, plastics, etc.) and processes (e.g., injection molding, MIM, sheet metal folding, welding, ultrasonic welding, additive manufacturing, subtractive machining, etc.).

Alternative embodiments and/or uses of the methods and devices described above and obvious modifications and equivalents thereof are intended to be included within the scope of the invention.

In the embodiments shown herein, the rear surface of the backplate 100 has a generally flat surface except for the disassembly notch 35, which generally mirrors the flat surface of the default backplate 5 for this make/model firearms. It is contemplated that, for firearms of other makes/models, the front and/or rear surfaces of the backplate 100 can be made to mirror the default backplates particular to those firearms.

In the embodiments shown herein, the rear surface of the backplate 100 has a generally flat surface except for the disassembly notch 35. In other embodiments of the inventive subject matter, the rear surface of the backplate 100 (the striker assembly lock 28, the extractor lock 25, or both) can include bumps, indentations, tabs, or otherwise textured or ribbed surface that provides additional friction with the user's thumb, facilitating installment and removal. In still other embodiments, the rear surface of the backplate 100 may instead/additionally have a sloped or curved shape that extends outward to allow for a better interaction with a user's finger or thumb for removal.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A toolless striker and firing pin removal and reinstallation system, comprising:

an extractor lock comprising:

a front surface configured to align with an extractor plunger of a firearm when the extractor lock is installed within a slide of the firearm;

at least one extractor lock lip disposed on at least a first side of the extractor lock, the extractor lock lip dimensioned to fit into at least one first corresponding section of a lip groove of the slide of the firearm; and an extractor lock detent chamfer; and a striker assembly lock comprising:

a front surface configured to align with a striker assembly sleeve edge of the firearm when the assembly lock is installed within the slide of the firearm;

at least one assembly lock lip disposed on at least a first side of the striker assembly lock, the assembly lock lip dimensioned to fit into at least one second corresponding section of the lip groove of the slide of the firearm; and an assembly lock detent chamfer;

wherein the extractor lock detent chamfer and assembly lock detent chamfer are configured to contact each other when the extractor lock and striker assembly lock are installed within the slide.

2. The system of claim 1, the extractor lock further comprising:

a divot disposed on the front surface, the divot comprising a chamfered top surface and at least one chamfered side surface;

wherein the divot is disposed on the front surface such that the chamfered top surface and the at least one chamfered side surface align with a corresponding surface of an extractor plunger.

3. The system of claim 2, wherein the corresponding surface of the extractor plunger comprises a rounded surface or a chamfered surface.

4. The system of claim 1, wherein the striker assembly lock is dimensioned to cover a trigger connector of the firearm when the striker assembly lock is installed on the slide and the slide is installed on the firearm.

5. The system of claim 1, the extractor lock further comprising a disassembly notch disposed on the rear surface of the extractor lock.

6. The system of claim 1, wherein a rear surface of at least one of the extractor lock or the striker assembly lock is textured.

* * * * *